United States Patent [19]

Saito et al.

[11] Patent Number: 5,040,659

[45] Date of Patent: Aug. 20, 1991

[54] INDICATING APPARATUS FOR PASSENGER CONVEYOR, INDICATING BODY USED THEREFOR AND METHOD OF ASSEMBLING THE APPARATUS

[75] Inventors: Chuichi Saito; Masamitsu Hanano, both of Katsuta; Hideo Kuwajima, Sapporo, all of Japan

[73] Assignees: Hitachi, Ltd., Tokyo; Hitachi Elevator Engineering Co., Ltd., Katsuta, both of Japan

[21] Appl. No.: 428,895

[22] Filed: Oct. 30, 1989

[30] Foreign Application Priority Data

Nov. 9, 1988 [JP] Japan ..... 63-281247

[51] Int. Cl.[5] ..... B66B 29/08

[52] U.S. Cl. ..... 198/324; 198/335

[58] Field of Search ..... 198/324, 335, 337, 338

[56] References Cited

U.S. PATENT DOCUMENTS

| | | | |
|---|---|---|---|
| 4,711,335 | 12/1987 | Watanabe . | |
| 4,871,056 | 10/1989 | Saito | 198/335 |

FOREIGN PATENT DOCUMENTS

| | | | |
|---|---|---|---|
| 275507 | 6/1964 | Australia | 198/335 |
| 0039274 | 3/1977 | Japan | 198/324 |
| 52-140182 | 11/1977 | Japan . | |
| 0040988 | 4/1978 | Japan | 198/335 |
| 0091283 | 8/1978 | Japan | 198/335 |
| 0091284 | 8/1978 | Japan | 198/335 |
| 0061086 | 5/1979 | Japan | 198/324 |
| 61-287692 | 12/1986 | Japan . | |
| 62-198002 | 9/1987 | Japan . | |
| 2180516A | 4/1987 | United Kingdom . | |

*Primary Examiner*—D. Glenn Dayoan

*Attorney, Agent, or Firm*—Fay, Sharpe, Beall, Fagan, Minnich & McKee

[57] ABSTRACT

Indicating apparatus for passenger conveyor includes an indicating body arranged near a platform of the conveyor and outside a balustrade panel. The indicating body is located and secured at a position where the upper edge thereof is downwardly apart from a frame which is mounted on the upper edge of the balustrade panel for supporting a moving handrail.

18 Claims, 5 Drawing Sheets

INDICATING APPARATUS FOR PASSENGER CONVEYOR, INDICATING BODY USED THEREFOR AND METHOD OF ASSEMBLING THE APPARATUS

FIELD OF THE INVENTION

The present invention relates to an indicating apparatus for a passenger conveyor, such as an escalator or an electrically driven pathway, and an indicating body used therefor and a method of assembling the apparatus.

DESCRIPTION OF THE RELATED ART

Heretofore, there is known, as disclosed in Japanese Patent Unexamined No. 61-287692, an indicating apparatus having an indicating body disposed on a balustrade at a position near to a platform for indicating information for passengers and for providing an improved decorative design of the apparatus.

In the above-mentioned arrangement, since a gap exists between the indicating body and the balustrade panel, there may be a risk that, when a passenger gets on the conveyor with his hand reached outward and downward of the moving handrail, his fingertip may be inserted into the above-mentioned gap formed at the upper end of the indicating body.

SUMMARY OF THE INVENTION

An object of the present invention is to provide an indicating apparatus for a passenger conveyor having an improved safety.

Another object of the present invention is to provide an indicating apparatus for a passenger conveyor which is supported with a sufficient stability.

Still another object of the present invention is to provide an indicating apparatus for a passenger conveyor in which an indicated information can be easily replaced and the maintenance and assembling of the apparatus are also easy.

For achieving these objects, in the present invention, an upper end of an indicating body, which is disposed outside the balustrade panel, is located at a position downwardly spaced apart from a frame which carries a moving handrail and is fixed to the panel.

Further, there are provided holding devices for supporting the upper and lower portions of the indicating body in a manner that the indicating body can be easily mounted and removed.

By virtue of the above-mentioned arrangement of the present invention, a risk of fingertip insertion into a gap above a indicating body is avoided, resulting in an improved safety of the apparatus, and the indicating body is surely supported with a sufficient stability. Further, since the indicating body is easily mounted and removed, the apparatus can be easily assembled, and the content of indication can be also easily changed.

DESCRIPTION OF THE PREFERRED EMBODIMENTS

Figure 1:
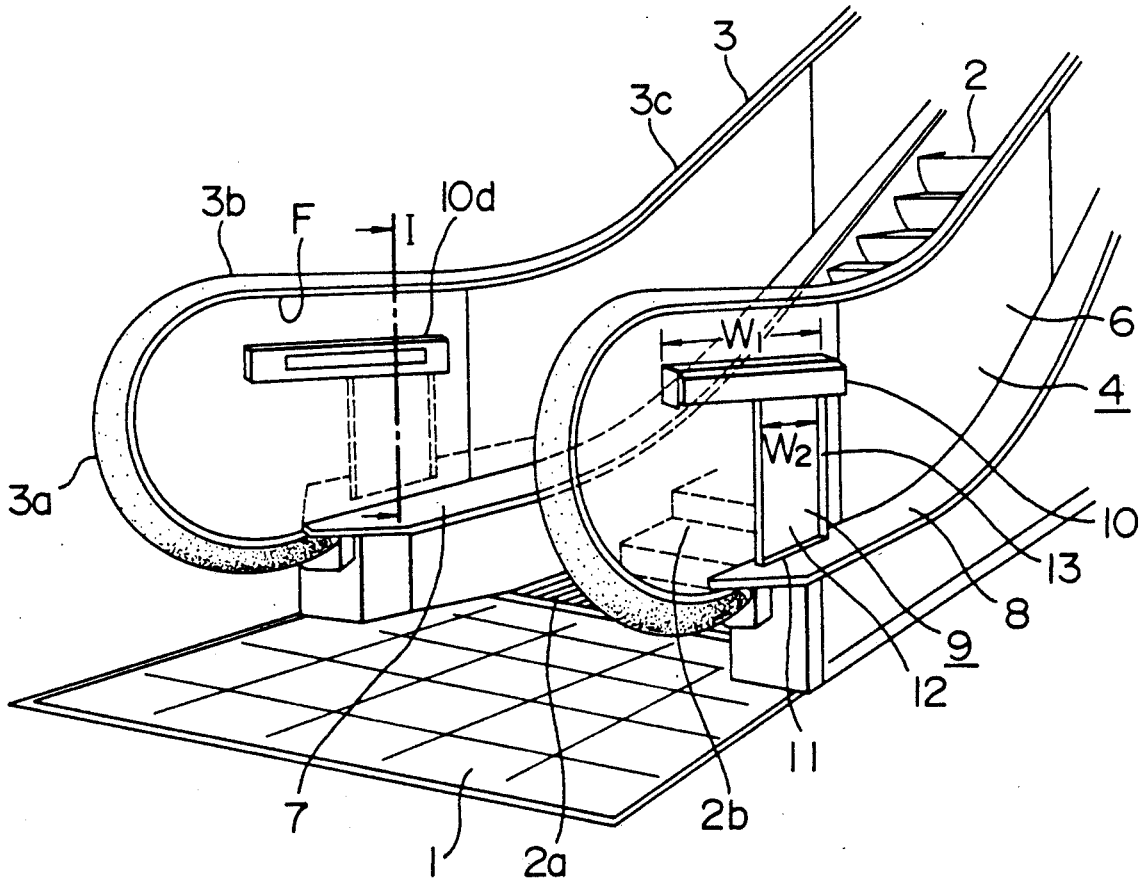
FIG. 1 is a perspective view of an indicating apparatus for a passenger conveyor according to an embodiment of the present invention.

Referring to FIGS. 1 to 6, an embodiment of the present invention applied to an escalator will be described below.

The basic structure of the escalator is conventional, and includes an endless step 2 moving along a horizontal path 2*a* and a slant path 2*b* from a platform 1 to another platform (not shown) and moving handrails moving in synchronism with the motion of the step along a turning path 3*a*, a horizontal path 3*b* and a slant path 3*c*. The moving handrail 3 is guided by a balustrade 4, which is supported by a main frame 5.

In general, the balustrade 4 includes a balustrade panel 6 made of a transparent reinforced glass and a frame F mounted on the upper portion of the balustrade panel 6 for guiding the moving handrail 3, and is fixed to the main frame 5 at its lower portion. The lower portion of the balustrade panel 6 to be fixed to the frame is covered by an inner deck cover 7 and an outer deck cover 8 at the inner side and the outer side of the panel, respectively.

In the above-mentioned escalator, an indicating apparatus 9 is disposed outside of the balustrade panel 6 at a position downwardly apart by a distance h (in FIG. 2) from the frame F of the horizontal path 3*b* of the moving handrail 3 near the platform 1. The indicating apparatus 9 includes an upper holder 10, a lower holder 11 and an indicating panel 12 indicating an indication content 12A. The upper holder 10 includes a support member 10A secured to the outside surface of the balustrade panel 6 and having a cross-sectional of a laterally turned U letter shape. An illuminating lamp 10B is disposed inside of the support member 10A, and an illuminating cover 10C is provided for covering the lamp and closing the opening of the support member. The support member 10A is formed with an aperture 10H at a surface opposed to the balustrade panel 6 (bottom surface of the U-shaped cross-section) for permitting the light of the lamp to penetrate the support member towards the balustrade panel 6. Further, the support member 10A includes an indicating body 10D having a transparent indicating portion 10*d* disposed on the inside surface of the balustrade panel 6. The indicating portion 10*d* has an information 10*e* (FIG. 5) such as letters, symbols, or patterns, which may be written, carved on the base plate of the indicating portion 10*d*, or may be written on a film adhered to the base plate for providing a passenger guide service. In addition, the support member 10A and the illuminating cover 10C are formed with grooves N and M, respectively, at the respective lower portions, into which the upper end of the indicating panel is inserted.

The lower holder 11 has a U-shaped cross-section for receiving the lower end of the indicating panel 12, and the bottom of the holder is fixed to the outer deck cover 8 by means of screws 11D. The lower holder 11 includes side walls 11A and 11B and an end wall 11C for receiving the indicating panel 12.

For fitting the indicating panel 12 between the upper holder 10 and the lower holder 11, the indicating panel 12 is so sized as to have a height greater than the distance from the lower surface of the upper holder 10 to the bottom of the lower holder 11 by a slight length Q, and firstly, the upper portion of the indicating panel is inserted into the grooves M and N in a direction indicated with arrow Pa by a distance corresponding to the depth of the U-shaped groove of the lower holder 11, and next, the lower end of the indicating panel 12 is lowered and inserted into the lower holder 11 in a direction indicated with arrow Pb. Thus, the indicating panel is held at the upper end portion thereof having the before-mentioned length Q, and is held at the lower end by the U-shaped lower holder. The breadth $W_1$ of the upper holder 10 is determined to be wider than the breadth $W_2$ of the indicating panel 12 for covering the upper edge of the indicating panel 12.

Along a side edge of the indicating panel 12 on the opposite side of the end wall 11C of the lower holder 11 there is disposed a hollow pillar 13 extending between the upper holder 10 and the lower holder 11, and wires 14 for supplying a electric power to the illuminating lamp 10B are passed through the hollow space of the pillar 13.

In the above-mentioned arrangement of the indicating apparatus according to the illustrated embodiment, since the upper end of the indicating panel 12 is downwardly apart from the frame F supporting the moving handrail 3 and covered by the upper holder 10 having a long breadth $W_1$, the fingertip of a passenger touches only on the upper holder 10 when the finger is moved over the indicating panel 6. Due to the touch of the finger on the upper holder 10, the passenger retracts his hand, thereby preventing his finger from being moved farther, caught by an edge of the indicating panel 12, or inserted into a gap between the indicating panel 12 and the balustrade panel 6.

Further, since the indicating panel 12 is held at its upper and lower portions by the upper holder 10 and the lower holder 11, respectively, the support of the indicating panel is very stable and can not be easily displaced even in case a child playing near the escalator shakes the indicating panel 12.

Further, since the indicating panel 12 can be mounted or removed by vertically moving the indicating panel relative to the upper holder 10 and the lower holder 11, the indicating apparatus can be simply assembled and the indicating panel can be easily mounted and removed for change of the indication content or for maintenance and inspection of the panel.

In the above-mentioned embodiment, the illuminating lamp 10B is disposed in the upper holder 10, and the indicating panel 12 has a slant upper end surface 12S opposed to the illuminating lamp 10B for introducing therealong light from the illuminating lamp 10B in order to illuminate the indicating panel 12. In addition, the light from the illuminating lamp 10B is adapted to penetrate the balustrade panel 6 for illuminating the indicating portion **10*d* of the indicating body 10D. In consequence, the present invention can be applied to an escalator in which it is impossible to mount an illuminating lamp on the frame F which guides the moving handrail 3**.

Further, the illuminating lamp 10B can be easily replaced only by removing and remounting the illumination cover 10C, because the illuminating lamp 10B is contained in the upper holder 10.

Figure 2:
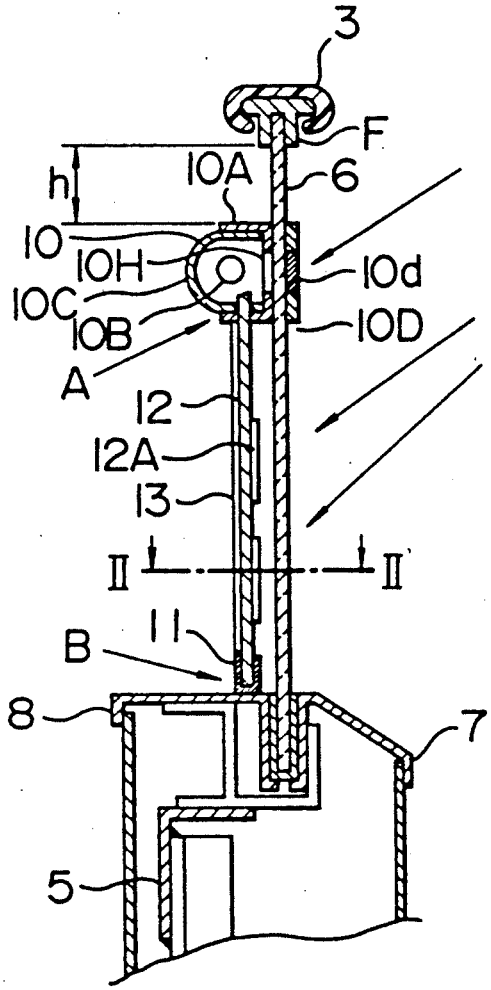
FIG. 2 is an enlarged cross-sectional view taken on line I—I of FIG. 1.

Another embodiment of the present invention will be described below by referring to FIG. 7. This embodiment is generally similar to that shown in FIG. 2, and the same members as shown in FIG. 2 are indicated with the same numerals and description therefor is omitted. Members different from those shown in FIG. 2 are only an upper holder 15 and a lower holder 16. The upper holder 15 has only a function of holding the upper end of the indicating panel 12 on the balustrade panel 6, while the lower holder 16 is secured to the outer deck cover 8 and has a hollow square cross-section, in which an illuminating lamp 16A is disposed.

In this embodiment, wires to be connected to the illuminating lamp 16A can be led from the lower holder 16 directly to the inside of the outer deck cover 8, and therefore, any support pillar 13 seen in the before-mentioned embodiment can be omitted.

Figure 7:
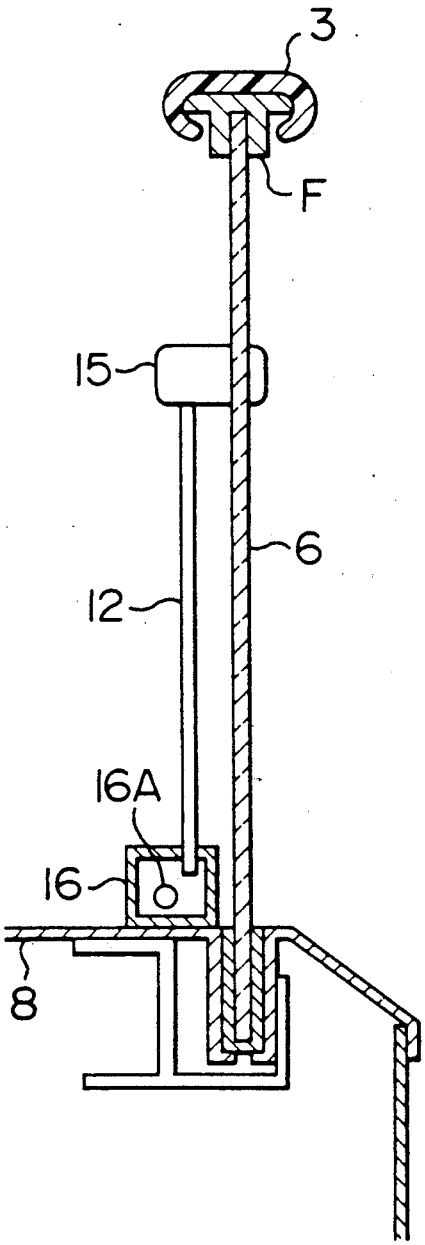
Figure 8:
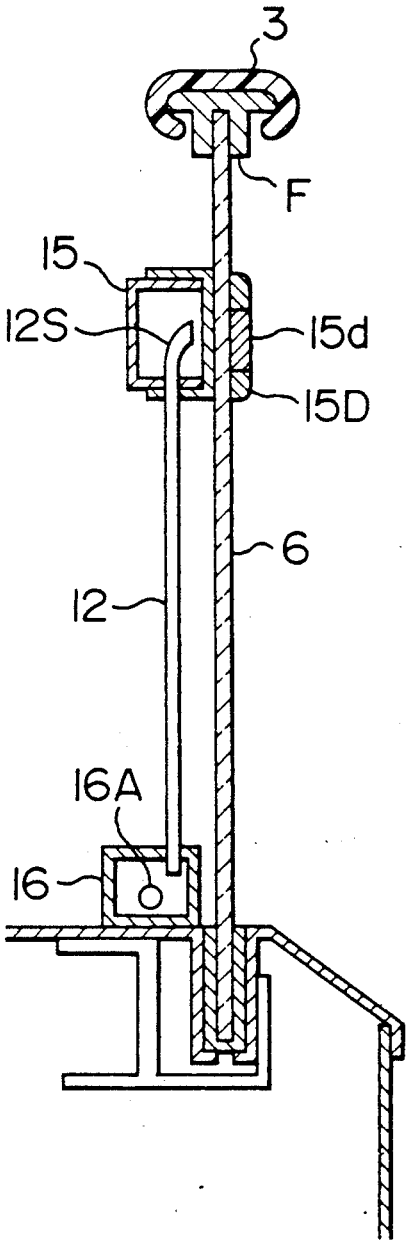

FIG. 8 shows a further embodiment developed from that shown in FIG. 7. An indicating body 15D including an indicating portion **15*d* is provided on the inner side of the balustrade panel 6 at a position opposite to the upper holder 15, and an illuminating lamp 16A is located at the lower portion of the indicating panel 12. In this case, the upper end of the indicating panel 12 is bent toward the indicating portion 15*d* so that the light from the illuminating lamp 16A may be passed through the interior of the indicating panel 12 and projected toward the indicating portion 15*d*. Thus, both of the indicating panel 12 and the indicating portion 15*d* can be illuminated at the same time by means of only one illuminating lamp 16A**.

Figure 9:
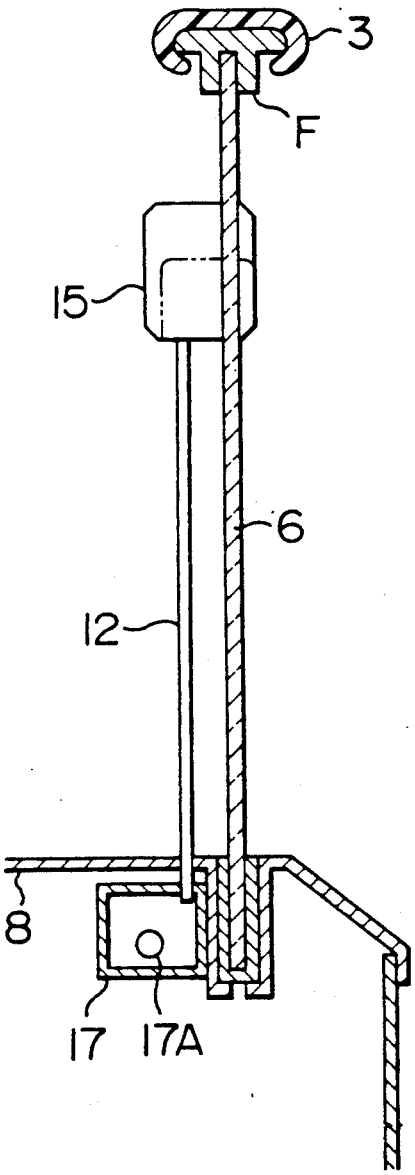

FIG. 9 shows a still further embodiment, in which the lower holder 17 is disposed inside the outer deck cover 8 and contains an illuminating lamp 17A therein, arrangements other than this being similar to those of FIG. 8. In this arrangement, the appearance of the apparatus is improved due to no existence of the lower holder 17 on the upper surface of the outer deck cover 8. In case the upper holder 15 is not required to have an indicating body 15D as shown in FIG. 8, the upper holder 15 can be decreased in its size to a size indicated in FIG. 9 by a two dot chain line, which is equivalent to that shown in FIG. 7.

In the above description, the present invention is applied to an escalator in which the frame F for guiding the moving handrail 3 is substantially enclosed by the moving handrail and fixed to the upper edge of the balustrade panel 6. However, the present invention can be applied not only to an escalator of this kind, but also to escalators in which, for example, the frame F largely protrudes for the moving handrail 3, and further, an illuminating lamp is mounted at the protruded frame F for illuminating the balustrade panel 6. Further, the present invention can be applied not only to an escalator, but also to an electrically driven pathway, of course.

Figure 10:
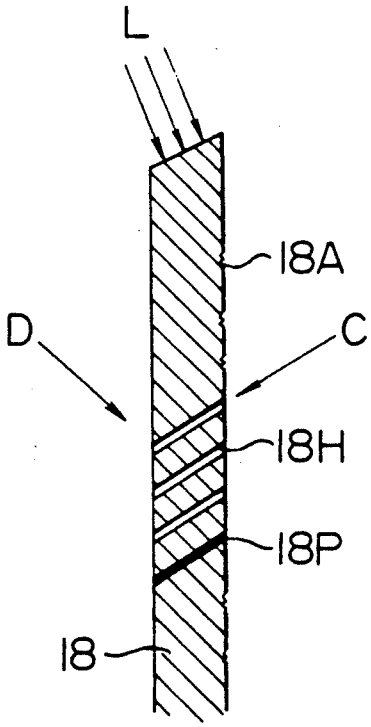
FIG. 10 is a cross-sectional view showing a main portion of an embodiment of an indicating body according to the present invention.

For indicating information on the indicating panel, there are measures such as writing or printing of indication content 12A directly on the indicating panel 12, or adhering a paper or film printed with the content. Further, according to indication contents, as shown in FIG. 10, unevenness 18A may be formed on a transparent acrylic plate by etching or carving, or a plurality of holes 18H may be drilled and, in addition, filled with paints 18P. When a light L is projected from the above of the indicating panel 18 as shown in FIG. 10, the light is reflected at the regions of these unevenness 18A or holes H, and perceived by passengers or passersby in directions indicated with arrows C and D.

Although, in the above description, the indicating panel is a plate made of a transparent material such as an acrylic plate, the indicating panel is not required to be a plate, but may be a plurality of optical fibers disposed parallel to one another and formed into a plate-like shape, or a combination of a plate and optical fibers.

Figure 3:
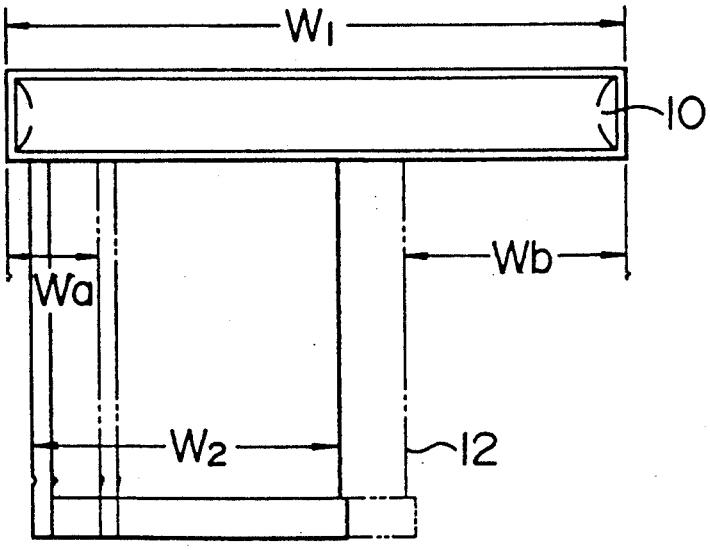
FIG. 3 is a left side view of the apparatus shown in FIG. 1.
Figure 4:
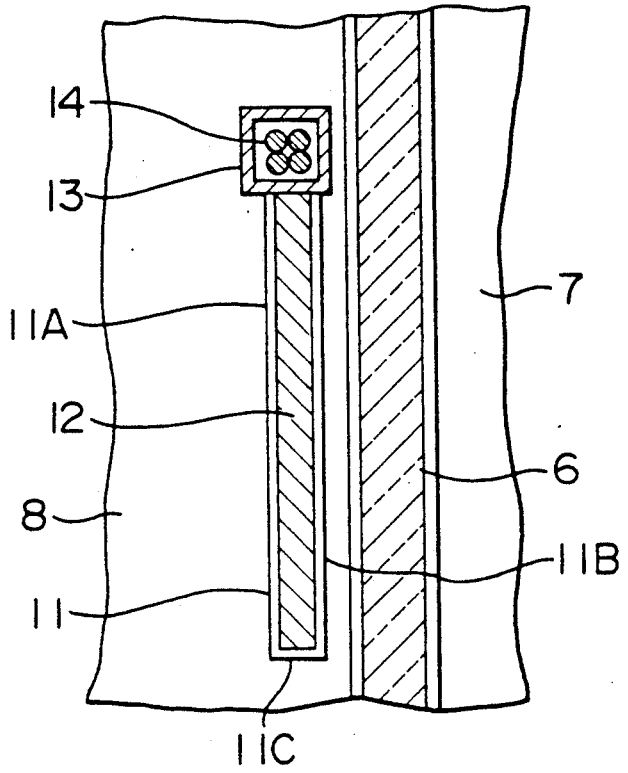
FIG. 4 is an enlarged cross-sectional view taken on line II—II of FIG. 2.
Figure 5:
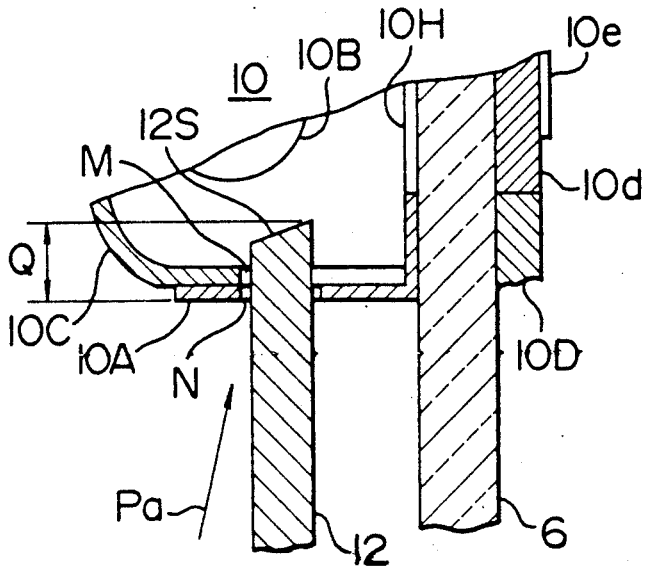
FIG. 5 is an enlarged view of the portion indicated with arrow A in FIG. 2.
Figure 6:
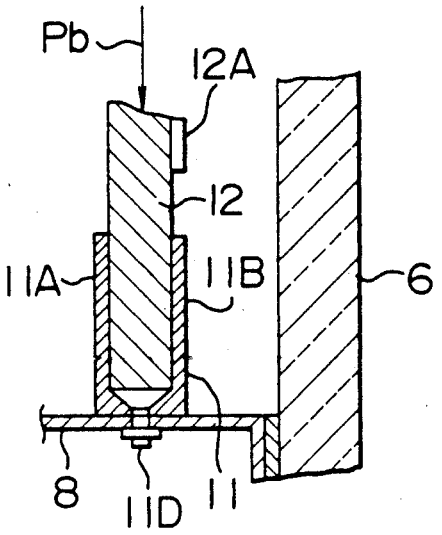
FIG. 6 is an enlarged view of the portion indicated with arrow B in FIG. 2, FIG. 7 to FIG. 9 are views similar to FIG. 2, showing the other embodiments according to the present invention.

In the above-mentioned embodiments, as shown in FIGS. 1 and 3, the breadth $W_1$ of the upper holder 10 is wider than the breadth $W_2$ of the indicating panel 12, and the indicating panel 12 is located aside with one side thereof near to one side of the upper holder 10. Therefore, when a passenger stretches his hand from a left upper position in FIG. 3 to a right lower position, there may be a risk that the tip of his finger firstly touches the indicating panel 12 without having touched the upper holder 10. In order to eliminate this risk, the indicating panel may be shifted to a position indicated in FIG. 3 with two dot lines, where the end portions of the upper holder extend beyond the side edges of the indicating panel by widths Wa and Wb, respectively. By virtue of this arrangement, the finger of a passenger is prevented from touching the indicating panel, because the finger firstly touches the upper holder and the hand is protected from further stretching. In other words, the upper holder has a function to inform a passenger of existence of the indicating panel therebelow, and to prevent the fingertip of a passenger from touching any corner or edge of the indicating panel.

As mentioned above, according to the present invention, the holder for holding the upper portion of the indicating panel to the balustrade panel is located downwardly apart from the frame supporting the moving handrail, and covers the upper edge of the indicating panel. As a result of this arrangement, the fingertip of a passenger stretched over the handrail is protected from contacting with any corner or edge of the indicating panel, or going into a gap between the indicating body and the balustrade panel.

Further, since the upper portion of the indicating body is secured to the balustrade panel, the indicating body cannot be easily displaced by any external force, resulting in a stiff mounting of the indicating body.

In addition, since the indicating body is easily mounted on and removed from the holders, the assembling of the indicating apparatus and the change of indicating contents are both simple, resulting in a simple and easy maintenance of the apparatus.

What is claimed is:

1. An indicating apparatus for a passenger conveyor including a platform, a moving handrail, a frame for supporting the moving handrail, an upstanding balustrade panel having an upper end and a lower portion, the upper end supporting the frame, a deck cover covering the lower portion of the balustrade panel, and an upstanding indicating body disposed near the platform and outside the balustrade panel to define a gap between the indicating body and the balustrade panel, the indicating body having an upper end located below the frame, comprising:

a supporting for supporting said indicating body, said support being structurally separate from said frame at the upper end of said indicating body, said indicating body support being secured to said balustrade panel and spaced downwardly from said frame, thus creating a free space between the indicating body and the frame.

2. An indicating apparatus for a passenger conveyor as claimed in claim 1, further comprising means provided at the upper end of said indicating body for closing said gap between the balustrade panel and the indicating body.

3. An indicating apparatus for a passenger conveyor as claimed in claim 1, further comprising a light source disposed inside said support for illuminating said indicating body.

4. An indicating apparatus for a passenger conveyor as claimed in claim 3, wherein said support is provided on an inner side of the balustrade panel with an indicating portion which is illuminated by said light source.

5. An indicating apparatus for a passenger conveyor including a platform, a moving handrail, a frame for supporting the moving handrail, an upstanding balustrade panel having an upper end and a lower portion, the upper end supporting the frame, a deck cover covering the lower portion of the balustrade panel, and an upstanding indicating body including an upstanding indicating panel disposed near the platform and outside the balustrade panel with a gap defined between the indicating body and the balustrade panel, the indicating body having an upper end located below the frame, comprising:

a protecting body for covering an upper end of the indicating panel, said protected body being secured to said balustrade panel in a position downwardly spaced from said frame.

6. An indicating apparatus for a passenger conveyor including a platform, a moving handrail, a frame for supporting the moving handrail, an upstanding balustrade panel having an upper and a lower portion, the upper end supporting the frame, a deck cover covering the lower portion of the balustrade panel, and an upstanding indicating body disposed near the platform and outside the balustrade panel with a gap defined between the indicating body and the balustrade panel, the indicating body having an upper end located below the frame, comprising:

a support for supporting said indicating body, said support being structurally separate from said frame at the upper end of said indicating body and downwardly spaced from the frame, thus creating a free space between the indicated body and the frame; and a caution body secured to said balustrade panel at a position downwardly spaced from said frame.

7. An indicating apparatus for a passenger conveyor including a platform, a moving handrail, a frame for supporting the moving handrail, an upstanding balustrade panel having an upper end and a lower portion, the upper end supporting the frame, a deck cover covering the lower portion of the balustrade panel, and an upstanding indicating body disposed near the platform and outside the balustrade panel to define a gap between the indicating body and the balustrade panel, the indicating body having an upper end located below the frame, comprising:

an upper support and a lower support for supporting the upper end and a lower portion of the indicating body, respectively, said upper support being structurally separate from said frame and secured to the balustrade panel in a position downwardly spaced from said frame.

8. An indicating apparatus for a passenger conveyor as claimed in claim 7, wherein the lower portion of said indicating body is located underside of said deck cover.

9. An indicating apparatus for a passenger conveyor as claimed in claim 7, further comprising a light source for supplying light to the indicated body, said light source being provided inside at least one of said upper and said lower supports.

10. An indicating apparatus for a passenger conveyor as claimed in claim 7, wherein said indicating body is formed to have a plate-like shape.

11. An indicating apparatus for a passenger conveyor as claimed in claim 10, wherein said indicating body is removably supported by said upper support and said lower support.

12. An indicating apparatus for a passenger conveyor as claimed in claim 10, wherein said indicating body is recorded with an indicating content.

13. An indicating apparatus for a passenger conveyor as claimed in claim 10, wherein the breadth of said indicating body is smaller than the length of said upper support.

14. An indicating apparatus for a passenger conveyor as claimed in claim 10, wherein said upper support extends in a substantially horizontal direction beyond the indicating body in two directions.

15. An indicating body for use with an indicating apparatus for a passenger conveyor having a platform, a moving handrail, a frame for supporting the moving handrail, an upstanding balustrade panel having an upper end and a lower portion, the upper end supporting the frame, a deck cover covering the lower portion of the balustrade panel, and an upstanding indicating body disposed near the platform and outside the balustrade panel to define a gap between the indicating body and the balustrade panel, the indicating body having an upper end located below the frame, comprising:

a support for supporting the upper end of the indicating body, said support being structurally separate from the frame and being secured to said balustrade panel at a position downwardly spaced from said frame, wherein said indicating body comprises a reflecting portion.

16. An indicating body for use with an indicating apparatus for a passenger conveyor as claimed in claim 15, wherein said indicating body is made of a transparent material.

17. An indicating apparatus for a passenger conveyor including a platform, a moving handrail, an upstanding balustrade panel having an upper end and a lower portion, the upper end supporting the frame, a deck cover covering the lower portion of the balustrade panel, and an upstanding indicating body disposed near the platform and outside the balustrade panel to define a gap between the indicating body and the balustrade panel, the indicating body having an upper end located below the frame, comprising:

a support for supporting the upper end of the indicating body, said support being structurally separate from the frame and being secured to said balustrade panel at a position downwardly spaced from said frame;

an illuminating lamp extending in a relatively longitudinal direction of said balustrade near said platform and outside the balustrade panel and secured to said balustrade panel in a region where said moving handrail runs in a substantially horizontal direction, said illuminating lamp being disposed at a position downwardly spaced from said frame; and wherein said indicating body is illuminated by said illuminated lamp.

18. A method of assembling an indicating apparatus for a passenger conveyor, said conveyor having a balustrade panel supporting along an upper portion thereof a moving handrail with a frame disposed therebetween and being covered by a deck cover along a lower portion of the same, comprising the steps of:

securing an upper holder to an outside surface of said balustrade panel at a position downwardly apart from said frame, and a lower holder to said deck cover, and then fitting said indicating body between said upper holder and said lower holder.

* * * * *